US010721983B1

(12) United States Patent
Subramanian et al.

(10) Patent No.: US 10,721,983 B1
(45) Date of Patent: Jul. 28, 2020

(54) HEADGEAR FOR USE IN BHARATNATYAM

(71) Applicants: Supriya S. Subramanian, Potomac, MD (US); Supreeta K. Subramanian, Potomac, MD (US)

(72) Inventors: Supriya S. Subramanian, Potomac, MD (US); Supreeta K. Subramanian, Potomac, MD (US)

(73) Assignee: SSI TECHNOLOGIES, Potomac, MD (US)

( * ) Notice: Subject to any disclaimer, the term of this patent is extended or adjusted under 35 U.S.C. 154(b) by 0 days.

(21) Appl. No.: 16/865,629

(22) Filed: May 4, 2020

Related U.S. Application Data

(62) Division of application No. 16/594,719, filed on Oct. 7, 2019.

(51) Int. Cl.

| | |
|---|---|
| ***A41G 5/00*** | (2006.01) |
| ***A42B 1/00*** | (2006.01) |
| ***A42B 1/22*** | (2006.01) |
| ***A45D 8/40*** | (2006.01) |
| ***A45D 8/00*** | (2006.01) |
| ***A44C 25/00*** | (2006.01) |
| *A45D 7/00* | (2006.01) |

(52) U.S. Cl.
CPC ..... *A41G 5/0093* (2013.01); *A41G 5/00* (2013.01); *A42B 1/004* (2013.01); *A42B 1/225* (2013.01); *A44C 25/00* (2013.01); *A45D 8/40* (2013.01); *A45D 2007/002* (2013.01); *A45D 2008/004* (2013.01)

(58) Field of Classification Search
CPC ..... A45D 2008/004; A45D 2008/006; A45D 8/40; A45D 8/002; A45D 7/00; A63H 3/44; A44C 25/00; A42B 1/04; A42B 1/004; A42B 1/041; A42B 1/225
USPC ..... 132/274, 275, 273, 53, 54, 201, 200; D28/93, 92; 2/174, 207, 410, 422, 2/209.13, 209.14, 171; 63/33
See application file for complete search history.

(56) References Cited

U.S. PATENT DOCUMENTS

| | | | | |
|---|---|---|---|---|
| 1,512,272 A * | 10/1924 | Burnet | A45D 8/40 | 132/274 |
| 3,898,868 A * | 8/1975 | Tomlinson | A44C 7/00 | 63/1.16 |
| 2012/0103014 A1* | 5/2012 | Monroe | A45D 8/14 | 63/12 |

* cited by examiner

*Primary Examiner* — Tatiana L Nobrega
*Assistant Examiner* — Sarah Woodhouse
(74) *Attorney, Agent, or Firm* — Sughrue Mion, PLLC

(57) ABSTRACT

A Bharatnatyam headgear comprising a wearable hair net, the hair net being pliable and expandable to be worn over a dancer's head and covering the head, the wearable hair net matching a color of the dancer's hair. A circular piece is affixed to the hair net. The circular piece is capable of being positioned in a middle of a forehead at a forward end of the hair partition of the dancer. A forehead piece is affixed to the hair net, the forehead piece extending in a horizontal direction capable of being positioned to coincide with a hairline in a left and right direction and extending at least beyond eyebrows of the dancer. A vertical piece is affixed to the hair net, the vertical piece being attached to the circular piece and extending across a middle of the head to cover the hair partition.

4 Claims, 4 Drawing Sheets

HEADGEAR FOR USE IN BHARATNATYAM

CROSS REFERENCE TO RELATED APPLICATIONS

This application is a divisional of U.S. application Ser. No. 16/594,719 filed on Oct. 7, 2019, which is incorporated herein by reference in it respective entireties.

BACKGROUND OF THE INVENTION

This disclosure teaches a Bharatnatyam headgear that includes all the ornamentation and that can be worn without much difficulty. Methods for using the Bharatnatyam headgear are also disclosed The country of India has at least seven forms of classical dances; namely Bharatnatyam, Kuchipudi, Yakshagana, Kathakali; Odishi, Manipuri, Kathak, Sattria and Mohiniattam. Bharatanatyam is the most popular and originated in the state of Tamil Nadu. Bharatnatyam expresses South Indian religious themes and spiritual ideas, particularly those representing stories and mythologies from the triumvirate and various others from the pantheons of Gods and Godesses. Natya Shastra by the venerated sage Bharat muni lays the theoretical foundations of Bharatnatyam. Texts as early as the Silappatikaram from the second century AD detail this dance form. Temple sculptures from the 6th to 9th century CE provide clear evidence that this dance was performed popularly through the first millenia AD. It is the oldest classical dance form in India.

Bharatanatyam uses a fixed upper torso with legs bent or knees flexed and uses a spectacular footwork. A vocabulary of sign language noted for its sophistication is used involving gestures of hands, eyes and face muscles. Live music accompaniment is provided usually with a main vocal musician and other accompanying instrumentalists. It uses an interpretive narration of mythical legends and spiritual ideas from the Hindu texts. The performance repertoire of Bharatanatyam includes nrita (pure dance), nritya (solo expressive dance) and natya (group dramatic dance).

The dress worn by a Bharatnatyam dancer consists of a fitted, brilliantly colored Sari which is mainly of warm colors with reflective pieces attached to it. The sari also has special pleated cloth stitched that falls in front and opens like a hand fan when the dancer flexes her knees or performs footwork. The dress is worn in a special way and typically held in place with a jewelry belt. The dancer is typically adorned with jewelry on her ear, nose, and neck that outlines her head or hair like a chain. Her face has conventional makeup, eyes lined and ringed accentuating her expressions. Her hair is tied up in the traditional way, often braided in with fragrant flowers (veni or gajra). She wears one or more leather anklets (ghungroos or salangai).

The dancer's fingers and feet outlines may be partially colored red with kumkum powder or alta, a costume tradition that helps the audience more easily view her hand and foot gestures.

The head jewelry typically consists of a Jumka which comprises a pair of earrings with an upward extending piece each. A Mattal which is worn on the forehead with a central piece that covers the parting of the hair ending in a round shaped bracelet positioned exactly on the forehead. It has two sidepieces that extend on either sides tracing the hairline on either sides. Surya, a sun piece is positioned on the left side of the head and a Chandra, a moon piece is positioned on the left side of the head. Traditionally all this jewelry is positioned separately on the head and clipped using hair clips.

Typically, for a performance in the late afternoon or evening a dancer has to start the dressing up and makeup process in the morning. After the hair do and facial makeup these jewelry pieces have to be positioned in its proper places on by one and attached using hair clips. After this, the rest of the makeup is done. The whole process can take upwards of three hours. All the while, the dancer is stressed and tired and her mobility is restricted significantly through the day.

It will be desirable to shorten the process and make it easier for the dancer to wear and position the jewelry in the appropriate place without causing much stress.

SUMMARY OF THE INVENTION

To realize the advantages mentioned above there is provided a Bharatnatyam headgear comprising a wearable hair net, the hair net being pliable and expandable to be worn over a dancer's head and covering the head, the wearable hair net matching a color of the dancer's hair. A circular piece is affixed to the hair net. The circular piece is capable of being positioned in a middle of a forehead at a forward end of the hair partition of the dancer. A forehead piece is affixed to the hair net, the forehead piece extending in a horizontal direction capable of being positioned to coincide with a hairline in a left and right direction and extending at least beyond eyebrows of the dancer. A vertical piece is affixed to the hair net, the vertical piece being attached to the circular piece and extending across a middle of the head to cover the hair partition. A moon piece is affixed to the hair net on a left side of the vertical piece, substantially shaped like a half moon. A sun piece is affixed to the hair net on a right side of the vertical piece, the sun piece being circular in shape. A leftside piece is affixed to the hairnet extending from below the moon piece and extending to the left ear, the leftside piece ending in and attached to a left earring piece which can be affixed to a left ear. A rightside piece is affixed to the hairnet extending from below the moon piece and extending to the left ear, the rightside piece ending in and attached to a right earring piece which can be affixed to a right ear. A plurality of hairpins are affixed to the hair net, the plurality of pins being positioned to secure the hair net firmly with the hair. A opening is provided at a rear end of the hairnet, the opening facilitating a braid to pass through.

In a specific enhancement, one or more circular artificial floral arrangements affixed to the hairnet and above the opening.

In another specific enhancement, an artificial hair braid affixed to the headgear.

In yet another specific enhancement a plurality of ornament pieces attached to the artificial hair braid.

Another aspect of the invention is a method of putting on a makeup for Bharatnatyam using the disclosed headgear. The method comprised passing a hairbraid through the opening. The hair net is positioned and expanded the hairnet to cover the head. The circular piece is positioned in the middle of the forehead at the end of the hair partition. The forehead piece is positioned to coincide with the hairline in a left and right directions. The vertical piece is positioned to extend across the forehead to cover the hair partition. The moon piece is positioned on the left side of the vertical piece. The sun piece is positioned on the right side of the vertical piece. The leftside piece is positioned and the left earring piece is attached to the left ear. The rightside piece is positioned and the right earring piece is attached to the right ear. The plurality of hairpins are attached to the natural hair of the dancer.

BRIEF DESCRIPTION OF THE DRAWINGS

The above and/or other aspects will become apparent and more readily appreciated from the following description of the exemplary embodiments, taken in conjunction with the accompanying drawings, in which.

DETAILED DESCRIPTION OF THE INVENTION

Figure 1:
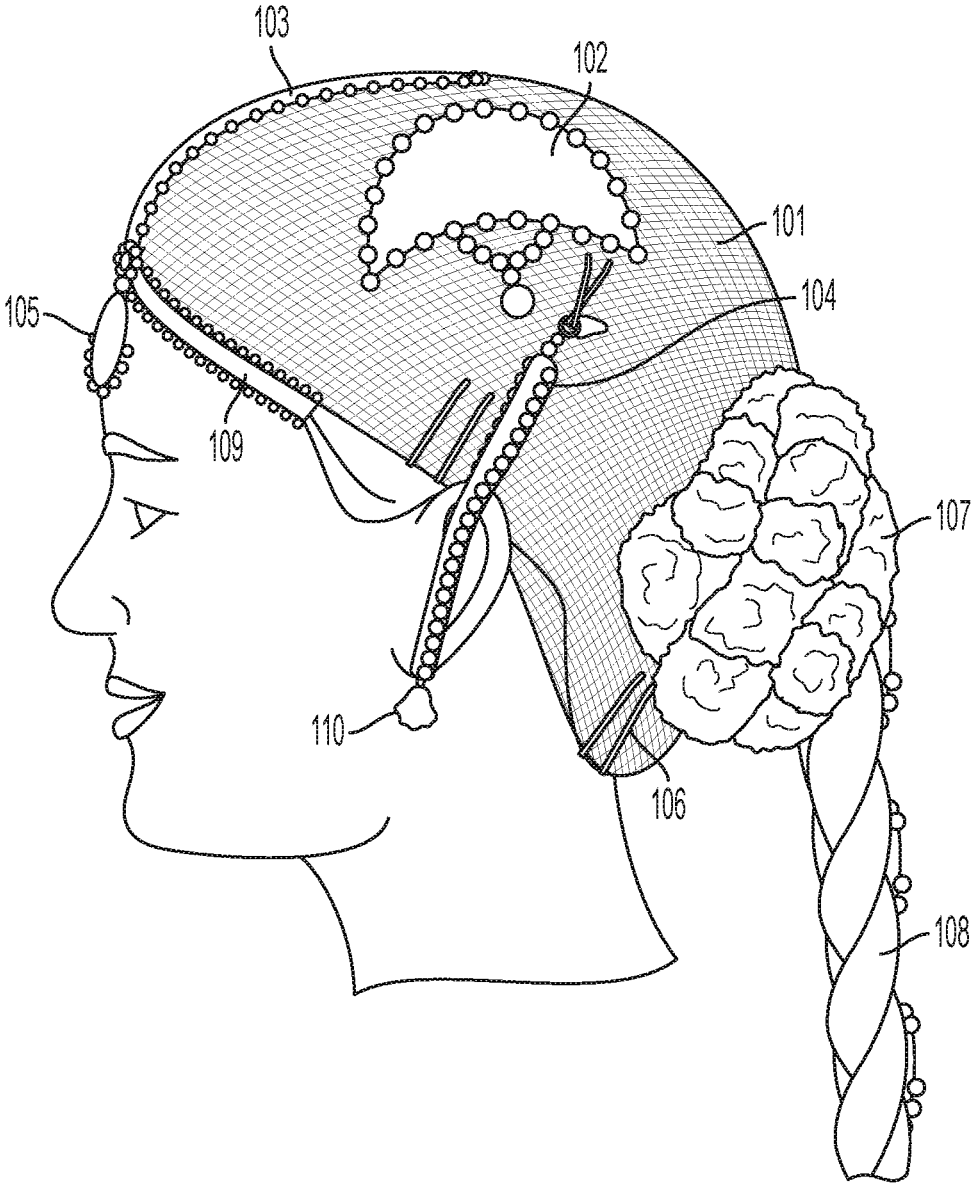
FIG. 1 is a schematic view of a dancers head from the left side, wearing an embodiment of the Bharatnatyam net of the present invention.
Figure 2:
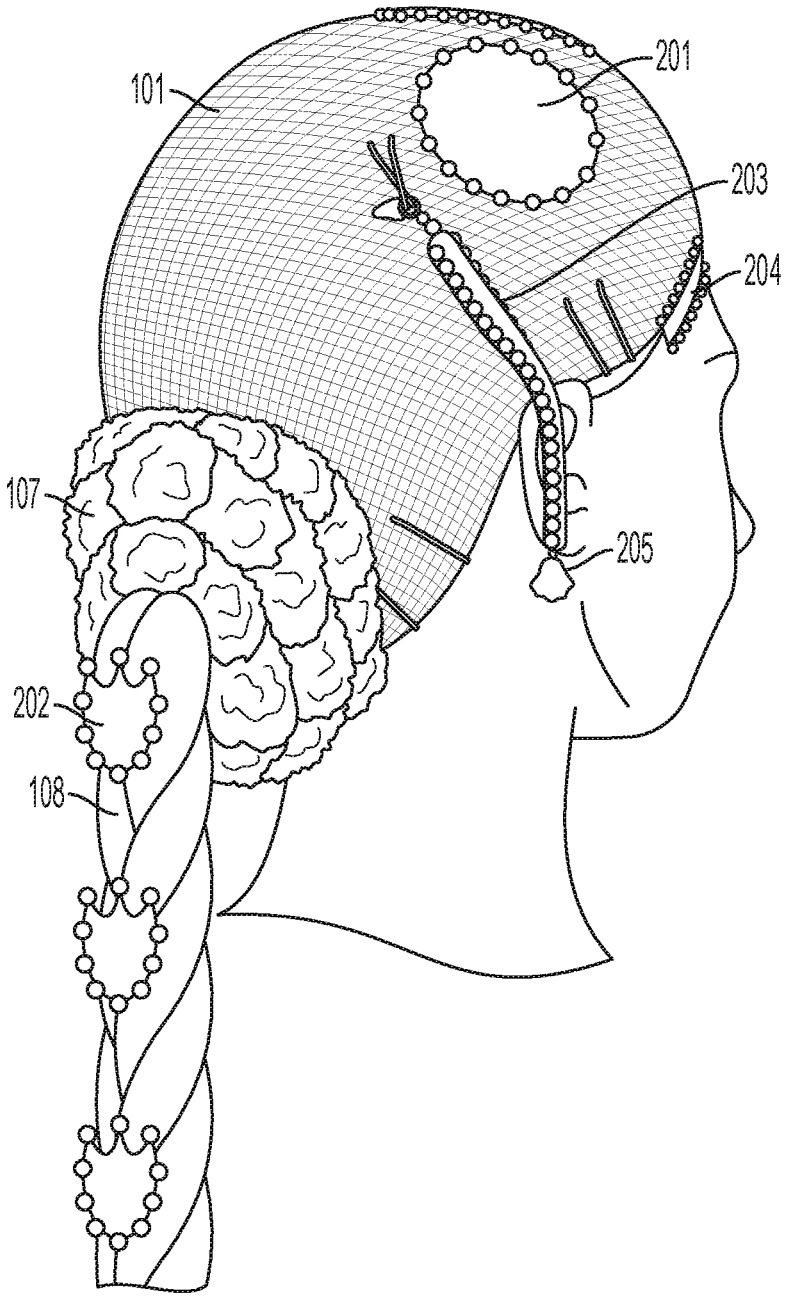
FIG. 2 is a schematic view of a dancers head from the right side, wearing an embodiment of the Bharatnatyam net of the present invention.
Figure 3:
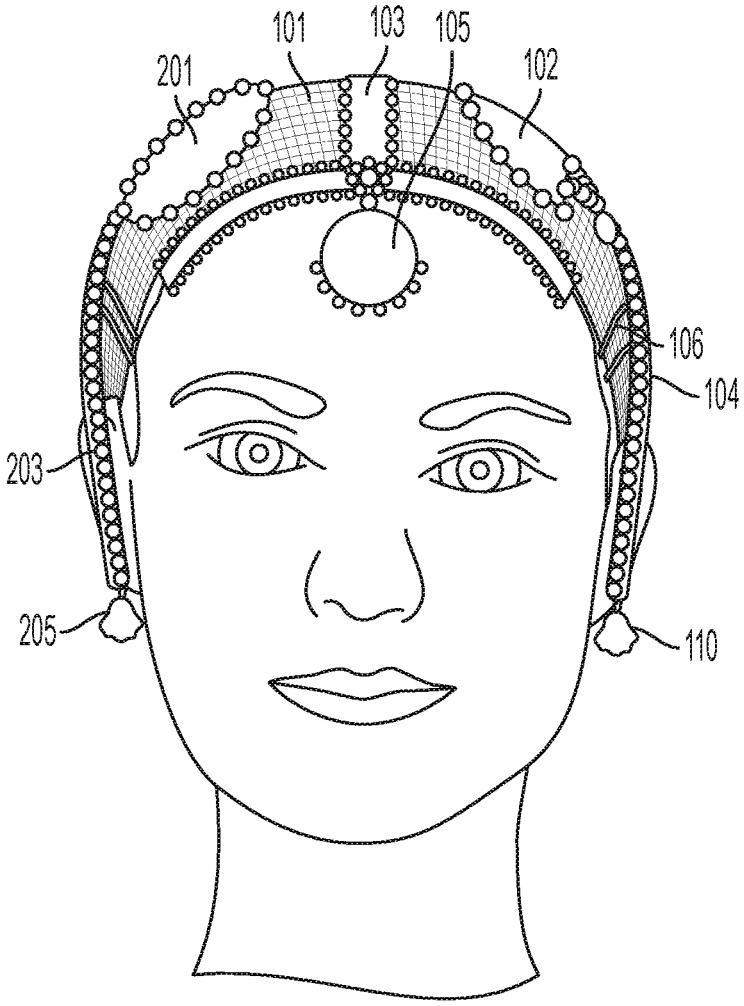
FIG. 3 is a schematic view of a dancers head from the front, wearing an embodiment of the Bharatnatyam net of the present invention.
Figure 4:
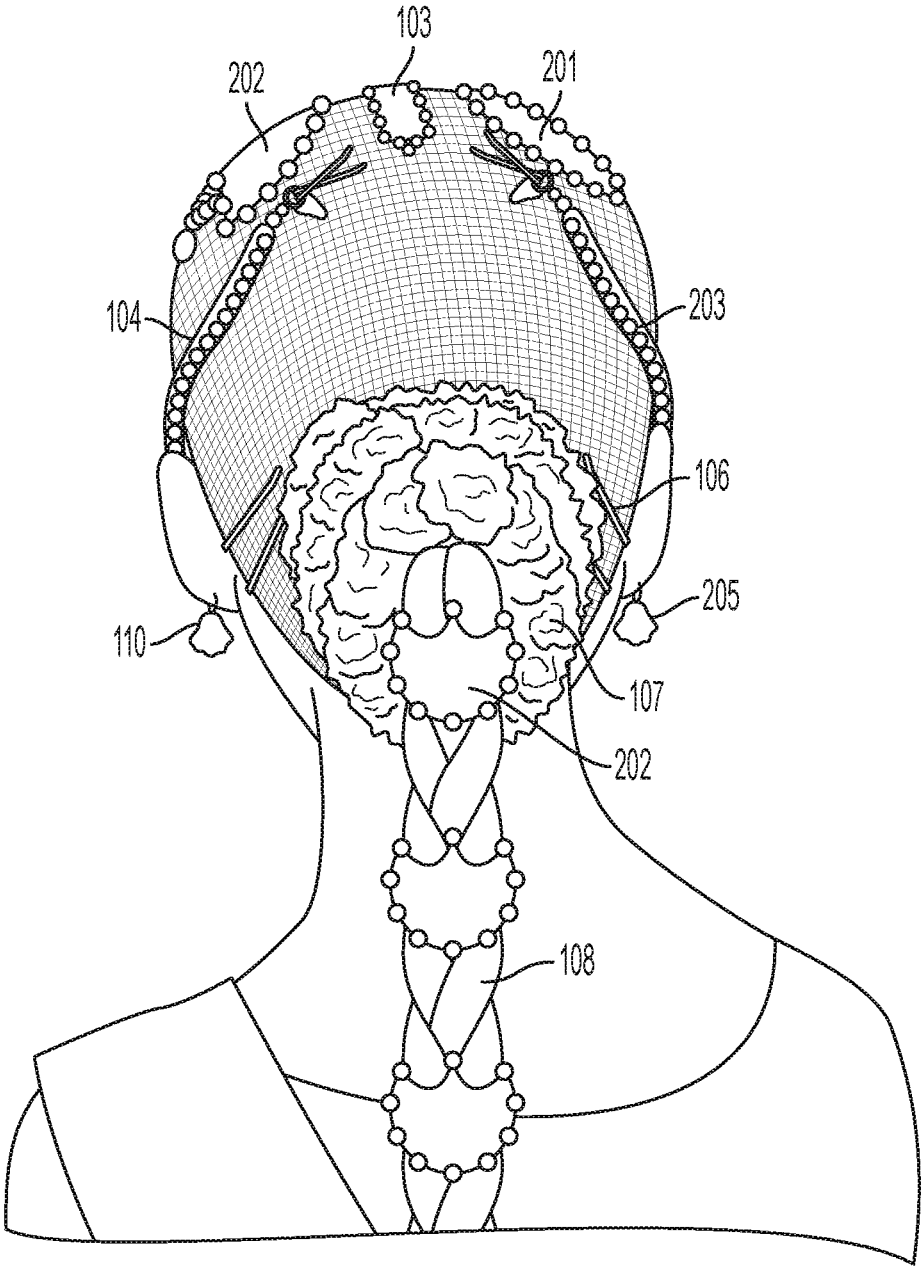
FIG. 4 is a is a schematic view of a dancers head from behind, wearing an embodiment of the Bharatnatyam net of the present invention.

FIGS. 1-4 describe a preferred embodiment of the Bharatnatyam headgear. It is described herein in detail. The base of the Bharatnatyam headgear of the present invention is a hairnet (item 101). It is a wearable hairnet. The hear net (item 101) is made of a pliable material. It can be expanded to snugly fit on a normal dancers head. It is elastic in nature and it can be made of natural or synthetic material. The hair net is made to match the hair color of the dancers. Typically in south India, young women and girls have dark black hair color. Therefore, the net would match such a hair color. However, in other parts of the world including US and Europe where Bharatnatyam dance form is becoming popular, women and girls have other hair colors including various shades of brown and blonde hair colors. Therefore, other colors to match the various hair colors are also contemplated. A circular piece (item 105) is affixed to the hair net (item 101). The circular piece (item 101) is capable of being positioned in the middle of the forehead at the end of the hair partition as shown in FIGS. 1 and 3. This circular piece (item 101) called a Mattal is about 1 inch in diameter. However, the size of this circular piece (item 101) can vary in size. Attached to the (item 101) and slightly above it is a forehead piece (item 109) affixed to the hair net. The forehead piece (items 109 and item 204) extends in a horizontal direction and is capable of being positioned to coincide with the hairline in a left and right direction and extending at least beyond the eyebrows of the dancer as shown in FIGS. 1 and 3. A vertical piece (item 103) is affixed to the hair net. The vertical piece (item 103) is attached to the circular piece (item 101) and extends across the forehead to cover the hair partition.

On the left side is a moon piece (item 102) affixed to the hair net on the left side of the vertical piece (item 103). It is called a Chandra and substantially shaped like a half moon. This is not attached to any other piece of jewelry but attached to the hairnet (item 101).

On the right side is a sun piece (item 201) affixed to the hair net on the right side of the vertical piece (item 103). The sun piece (item 201) is circular in shape like the shape of the sun.

A leftside piece (item 104) is affixed to the hairnet (item 101) t extending from below the moon piece (item 102) and extending to the left ear. The leftside piece (item 104) ends in and is attached to a left earring piece (item 110) which can be affixed to the left ear. A rightside piece (item 203) is affixed to the hairnet (item 101) t extending from below the sun piece (item 201) and extending to the left ear. The leftside piece (item 104) ends in and is attached to a left earring piece (item 110) which can be affixed to the left ear. A plurality of hairpins (item 106) are affixed to the hair net (item 101) as shown in the figures. These plurality of pins (item 106) are positioned to secure the hair net (item 101) firmly with the hair, An opening is provided at the rear end of the hairnet (item 101). The opening is not seen in any of the figures as it is hidden. The opening facilitates a braid (item 108) to pass through.

Additionally as a further improvement, one or more circular artificial floral arrangements (item 107) can be affixed to the hairnet (item 101) and above the opening. In another improvement, if the dancer does not have natural hair long enough for the occasion, an artificial hair braid (item 108) can be affixed to the headgear. In another improvement, ornament pieces (item 202) can be attached to the hair braid (item 108).

Any type of jewelry using gold, silver, other precious metals, artificial materials, materials plated with gold, silver, etc are contemplated without deviating from the spirit of the invention.

An aspect of this invention is a method of wearing the Bharatnatyam headgear described above. The dancer first sets her hair partitioning in the middle and forming a ponytail hairbraid. She then passes the hairbraid through the opening After that the dancer positions the hair net (item 101) and expands the hairnet (item 101) to cover the head. The circular piece (item 105) is in the middle of the forehead at the end of the hair partition as shown in the figure. The forehead piece (items 109 and 204) is positioned to coincide with the hairline in a left and right directions. The vertical piece (item 103) is positioned to extend across the forehead to cover the hair partition. The moon piece (item 102) is positioned on the left side of the vertical piece (item 103). The sun piece (item 201) is positioned on the right side of the vertical piece (item 103). The leftside piece (item 104) is positioned on the left side and extended to the left ear and the left earring piece (item 110) is attached to the left ear. The rightside piece (item 203) is positioned on the right side and extended to the right ear and the right earring piece (item 205) is attached to the right ear. The plurality of hairpins (item 106) are attached to the natural hair of the dancer so that the Bharatanatyam headgear snugly fits on top of the head.

While the headgear is disclosed specifically for Bharatnatyam, a skilled artisan would know that similar headgears can be made for other types of dances and for wearing other jewelry on the head.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A method of putting on a dancer's Bharatnatyam headgear, the method comprising:

providing a Bharatnatyam headgear comprising:

a wearable hair net having a substantially hemispherical shape with a peripheral edge defining a first opening, the hair net having a front end and a rear end located opposite the front end, wherein a centerline extending from a midpoint of the front end to a midpoint of the rear end and divides the hair net into a left side located on a first side of the centerline and a right side located on a second side of the centerline, the hair net being pliable and expandable such that during use, the first opening is expanded over and covers a dancer's scalp, wherein the wearable hair net matches a color of the dancer's hair;

an elongated forehead piece affixed to a central portion of the peripheral edge at the front end of the hair net, the forehead piece extending along the peripheral edge in a horizontal direction, and configured to be positioned to coincide with a frontal portion of a hairline of the dancer, the elongated forehead piece having a left terminal end and a right terminal end which are configured to extend at least beyond the dancer's left and right eyebrows, respectively;

an elongated vertical piece affixed to the hair net along the centerline, the elongated vertical piece having a front end and a back end, wherein the front end extends from a midpoint of the forehead piece, such that the elongated vertical piece extends transversely from the forehead piece;

a circular piece affixed to the front end of the elongated vertical piece, and extending below the peripheral edge and the forehead piece, such that the circular piece is configured to be positioned in a middle of a forehead of the dancer;

a moon piece affixed to the left side of the hair net proximate the back end of the vertical piece and substantially in the shaped of a half moon;

a sun piece affixed to the right side of the hair net proximate the back end of the vertical piece when facing the dancer, the sun piece being circular in shape;

a leftside piece having an upper section and a lower section, the upper section is affixed to the left side of the hair net extending from below the moon piece to the peripheral edge such that the leftside piece is spaced apart from the left terminal edge of the forehead piece, and the lower section hangs below the peripheral edge and terminates in a left earring piece, wherein during use the lower section hangs over a left ear of the dancer and the left earring piece is affixed to the dancer's left ear;

a rightside piece having an upper section and a lower section, the upper section is affixed to the right side of the hair net extending from below the sun piece to the peripheral edge such that the rightside piece is spaced apart from the right terminal edge of the forehead piece, and the lower section hangs below the peripheral edge and terminates in a right earring piece, wherein during use the lower section hangs over a right ear of the dancer and the right earring piece is affixed to the dancer's right ear;

a plurality of hairpins affixed to the hair net, the plurality of hairpins being positioned along the peripheral edge for securing the hair net firmly with the dancer's hair;

a second opening positioned at a central portion of the rear end of the hair net, such that the centerline extends through the second opening, the second opening facilitating a braid to pass through during use;

creating a hair partition in a middle of the dancer's hair;

braiding the dancer's hair into a hairbraid;

passing the hairbraid through the second opening of the Bharatnatyam headgear;

positioning the first opening of the Bharatnatyam headgear over the dancer's scalp and expanding the hair net to cover the dancer's scalp such that the peripheral edge extends proximate to the dancer's natural hairline;

positioning the circular piece in the middle of the forehead at a front end of the hair partition;

positioning the forehead piece to coincide with the dancer's hairline adjacent the forehead in a left and right directions;

positioning the vertical piece to cover the hair partition;

positioning the leftside piece such that the lower portion of the left side piece hangs over the dancer's left ear and attaching the left earring piece to the left ear;

positioning the rightside piece such that the lower portion of the right side piece hangs over the dancer's right ear and attaching the right earring piece to the right ear;

attaching the plurality of hairpins to natural hair of the dancer to secure the hair net firmly with the dancer's natural hair.

2. The method of claim 1, wherein the Bharatnatyam headgear further comprises one or more circular artificial floral arrangements are affixed to the hairnet and above the second opening.

3. The method of claim 1, wherein an artificial hair braid is affixed to the Bharatnatyam headgear.

4. The method of claim 3 wherein a plurality of ornament pieces are attached to the artificial hair braid.

* * * * *